United States Patent [19]

Goldie

[11] 4,245,197

[45] Jan. 13, 1981

[54] RADAR RECEIVER PROTECTOR WITH AUXILIARY SOURCE OF ELECTRON PRIMING

[75] Inventor: Harry Goldie, Randallstown, Md.

[73] Assignee: Westinghouse Electric Corp., Pittsburgh, Pa.

[21] Appl. No.: 881,956

[22] Filed: Feb. 27, 1978

[51] Int. Cl.[2] ..... H01P 1/14; H01J 7/46

[52] U.S. Cl. ..... 333/13; 315/39; 333/99 MP; 333/258

[58] Field of Search ..... 333/13, 99 PL, 99 MP, 333/248, 258, 17 L; 250/399; 325/21–24; 315/39

[56] References Cited

U.S. PATENT DOCUMENTS

| | | | |
|---|---|---|---|
| 2,575,134 | 11/1951 | Schultz et al. | 250/496 |
| 2,847,581 | 8/1958 | Clark | 250/496 |
| 3,781,719 | 12/1973 | Durkee | 333/13 |
| 4,027,255 | 5/1977 | Blakeney et al. | 333/13 |

*Primary Examiner*—Marvin L. Nussbaum
*Attorney, Agent, or Firm*—W. E. Zitelli

[57] ABSTRACT

A microwave discharge gap receiver protector includes a radioactive ignitor of the nuclear decay type to provide an auxiliary source of electron priming therefore, the radioactive ignitor comprising a radioactive plate for emitting beta particles therefrom, and a tubular enclosure to channel the flow of emitted beta particles therethrough. In operation, a portion of the channeled emitted beta particles collide with the inner walls of the enclosure which are comprised of a material having a high secondary emission characteristic to generate additional electron particles as a result of secondary emission. Another portion of the beta particles in the channel of the tubular enclosure collide with existing gas particles to generate a second source of auxiliary electrons. The combined sources of auxiliary electrons result in an increased particle concentration which is emitted at an exit end of the enclosure and directed to the discharge gap of the receiver for priming purposes. In addition, the tubular enclosure may have distributedly applied longitudinally thereacross a predetermined voltage potential primarily for enhancing the movement of the slower secondary electrons which are emitted at the priming electron exit end of the enclosure.

5 Claims, 3 Drawing Figures

FIG.1
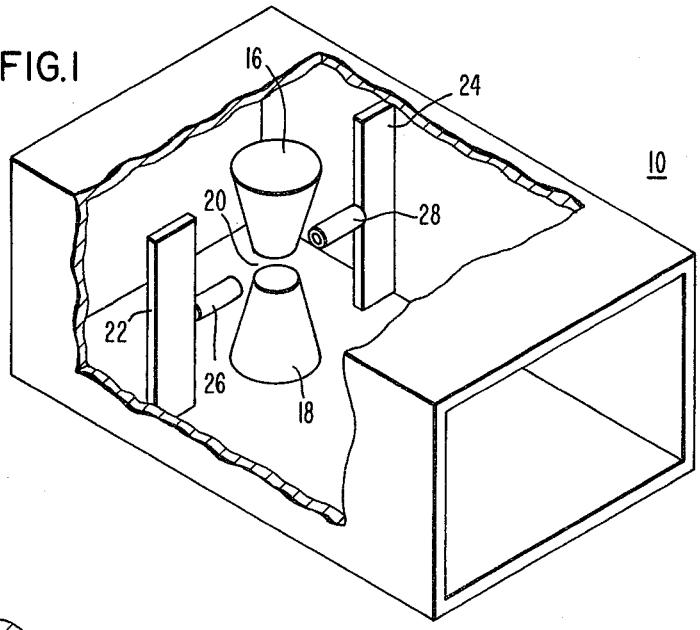
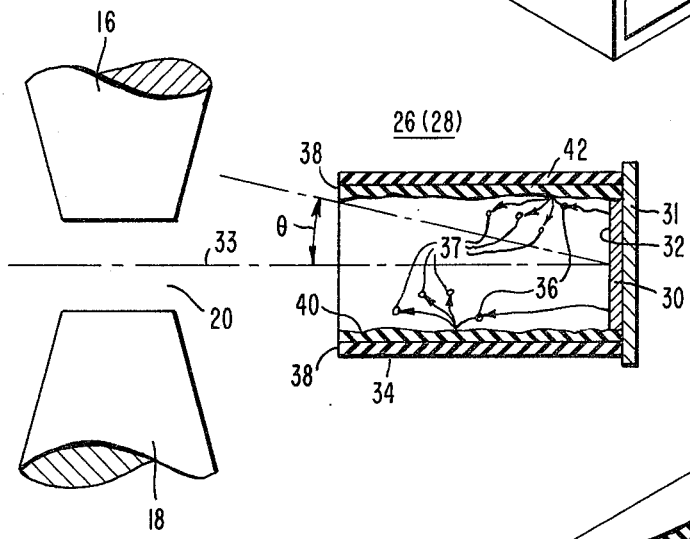
FIG.2
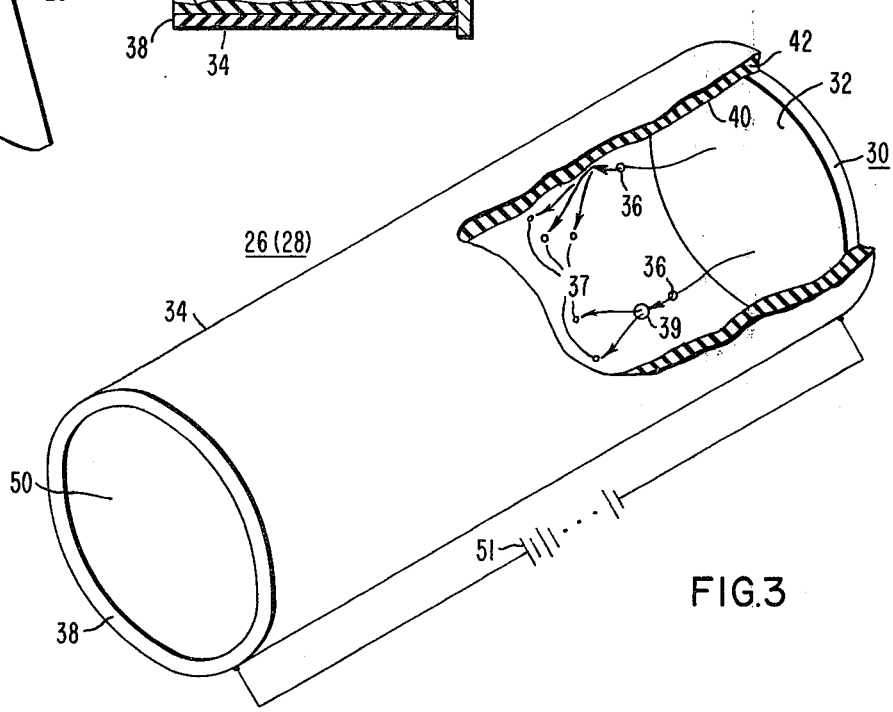
FIG.3

RADAR RECEIVER PROTECTOR WITH AUXILIARY SOURCE OF ELECTRON PRIMING

GOVERNMENT CONTRACT

The invention herein described was made in the course of or under a contract or subcontract thereunder with the Department of the Air Force.

BACKGROUND OF THE INVENTION

This invention relates broadly to the field of radar receiver protectors such as TR tubes, and more particularly, to an auxiliary electron source device which renders an electron concentration in the vicinity of the microwave discharge gap of the receiver protector permitting reliable and rapid low threshold breakdown protection therefrom.

In a typical radar application, one might expect radar power transmissions to be approximately $10^6$ watts while the maximum safe power that a receiver may typically withstand is only a few watts. It is apparent that some type of protective isolation is required between the transmitter and receiver which in some cases must be on the order of 60 db. TR tubes are generally provided in radar receivers to protect the receiver from burnout or damage during these radar power transmissions. One type of TR tube comprises a length of waveguide section sealed at both ends with glass or ceramic windows transparent to microwave frequencies. In most cases, the TR tube is evacuated to a low gas pressure on the order of a few torrs. Inside the sealed section of waveguide is a microwave discharge gap which is formed by a pair of truncated cones (electrodes), which are coupled to opposite walls of the waveguide. The spark gap is well suited as a TR switch since its impedance is high in the unfired condition and low when fired. Iris plates are generally positioned in the TR tube in a plane which is perpendicular to the walls of the waveguide and aligned approximately within the plane of the center cross-section of the pair of truncated cones. The combination of the iris plates and cone gap form a resonant-filter section in the TR tube wherein the cones are capacitive and the iris plates are inductive filter elements. The filter section aids in the breakdown process by producing a relatively high value of electric field strength in the region of the gap of the truncated cones.

TR tubes in general are not ideal limiters; some transmitted power always leaks through to the receiver. The envelope of an R-F leakage pulse of a TR tube almost always includes a short-duration large-amplitude "spike" at the leading edge of a transmitted pulse which is a result of the finite time lag for breakdown of the gas. It is well known that damage may be caused to the receiver, more specifically the crystal mixer contained therein, if the energy contained within the spike is too large. Normally, to ensure reliability and rapid breakdown of the TR tube upon application of the RF transmitted pulse, an auxiliary source of electrons is often supplied to the TR tube.

A classical electron source ignitor has been attained with a weak "keep-alive" d-c discharge between an additional electrode introduced into the tube and one of the truncated cone electrodes of the TR. Electrons from the keep-alive discharge diffuse into the TR gap, where they act to trigger the breakdown once RF power is applied. One disadvantage of the keep-alive electrode is that it generates noise in a similar manner as does other gas-discharge devices. If too strong a discharge is maintained, the noise level might be high enough to degrade the receiver sensitivity. Another disadvantage of the d-c ignitor is that it requires a high voltage source, on the order of 1000 volts which is generally synchronized to the RF power pulses of the transmitter. Still another disadvantage is that the d-c ignitors have a relatively short lifetime, around 500–1000 hours typically, as a result of erosion of the electrodes due to ion backbombardment. To overcome these disadvantages, radioactive ignitors have been recently introduced into TR tubes as an auxiliary electron source to replace the classical d-c type ignitors.

These present radioactive ignitors are little flat disks which may be disposed on the iris plates in the TR tube in parallel planes facing the microwave discharge gap. The radioactive ignitors spontaneously emit electrons hemispherically therefrom in the direction of the discharge gap independent of the RF transmissions and without the need of a high voltage power source. However, these radioactive ignitors, generally of the metallic tritide variety, cannot provide the same priming electron densities as that which is typically available from the classical d-c ignitors and thereby permit large leakage spikes and random firing thresholds to occur. To protect the receiver further from these conditions, a plurality of diodes, known as diode limiters, are shunted across the transmission line in the waveguide a predetermined distance from the discharge gap. The diode limiters set up a reflecting field which has a maxima in the plane in the microwave discharge gap in order to enhance the electric field there to lower the firing power threshold. One disadvantage is that diode limiter which must be employed causes an insertion loss which adds to the radar noise figure of the below threshold level signals and may degrade the radar sensitivity.

In summary then it appears that the radioactive ignitors have eliminated the disadvantage of employing a high voltage source synchronized to the radar pulse transmissions and relatively short lifetimes which are both associated with the classical d-c ignitors. But, they presently have a low electron supply rate and require a plurality of diode limiters as supplemental receiver protection. These diode limiters cause insertion losses which contribute to the radar noise figures of the below threshold level signals. If radioactive ignitors are to become a viable auxiliary source of electron priming to ensure reliability and rapid breakdown of the cone gap in the TR tubes, it is of paramount importance to provide an improvement in the priming electron densities emitted therefrom. If the electron supply rate of the radioactive ignitors could be made close to that available from the classical d-c ignitors, a reduction in the number of diode limiters required would be realizable. An improvement in the electron supply rate will ensure adequate protection against the large-amplitude spike leakage and the reduction in diode limiters will ultimately lower the insertion loss contribution to the radar noise figures.

SUMMARY OF THE INVENTION

In accordance with the present invention, a radioactive ignitor is comprised of a plate of radioactive material which has at least one surface emitting beta particles as a result of nuclear decay; and a tubular enclosure having one end substantially enclosing the emitting surface of the radioactive plate to restrict the flow of beta particles therefrom to the channel of the tubular enclosure causing a portion of the emitted beta particles to strike the interior surface of the tubular structure prior to exiting at the other end which is open. The interior surface of the enclosure is comprised of a lossy material having the characteristics of high secondary emission of electrons. Additional electrons are rendered from the collision of beta particles with the interior surface of the enclosure effecting a multiplication of emitted particles manifested at the exit end of the enclosure. More specifically, the tubular enclosure may be any structure having a channel formed by at least three walls, but is preferably a cylindrical structure having a circular cross-section whose length is approximately three times its diameter. The interior surface of the enclosure is preferably comprised of a material similar to silver magnesium oxide which may have, in some cases, an exterior insulating layer of a material similar to aluminum oxide. The radioactive material is preferably comprised of a metallic tritide similar to that having the formula $TiH^3$. The tubular enclosure may further include a predetermined voltage potential distributedly applied longitudinally thereacross, in which case, the walls of the structure may be preferably comprised of aluminum oxide.

These radioactive ignitors may provide an auxiliary source of electrons for a microwave gas discharge type of radar receiver protector, like a TR tube, for example, which is generally comprised of a waveguide section having disposed therein at least one pair of truncated electrode cones to form at least one cone gap, and at least two iris plates positioned in relation to each gap to form a tuned resonantfilter therewith. At least one radioactive ignitor is positioned within the waveguide section to have its exit end directed to and within a predetermined distance from the corresponding cone gap. The emitted particles of the at least one radioactive ignitor are diffused to the region of the corresponding cone gap to establish an electron priming concentration which provides a reliable and rapid low threshold breakdown of the discharge gap to protect a radar receiver from large-amplitude spike leakage from high-power microwave signals.

BRIEF DESCRIPTION OF THE DRAWINGS

FIG. 1 depicts an embodiment of a receiver protector suitable for embodying the principles of the invention;

FIG. 2 is a cross-sectional view of one embodiment of a radioactive ignitor shown in relation to a discharge gap formed by a pair of truncated electrode cones; and FIG. 3 depicts an alternate embodiment of a radioactive ignitor.

DESCRIPTION OF THE PREFERRED EMBODIMENTS

In FIG. 1 is shown a waveguide section 10 which may be coupled between a radar transmitter and radar receiver (not shown) in a conventional radar set waveguide coupling arrangement. The waveguide section 10 may be sealed at both ends and have a gas mixture such as that comprising ammonia and water vapor and a noble gas such as krypton or argon contained within the sealed waveguide section 10 at pressures of 5 to 25 torrs, for example (760 torrs is equivalent to 1 atmosphere). The waveguide section 10 is utilized in the present embodiment as an envelope which may hermetically contain a microwave gas discharge type TR tube for providing receiver protection and switching in a radar set. For this purpose, at least two truncated cones 16 and 18 are disposed within the waveguide section 10 to form a microwave discharge gap 20. Iris plates 22 and 24 are positioned on either side of the microwave cone gap 20 in such a relation to the truncated cones 16 and 18 to form a resonant-filter section wherein the truncated cones 16 and 18 are the capacitive elements and the iris plates 22 and 24 are the inductive elements. One function of this resonant-filter relationship is to aid in the breakdown process of the microwave discharge gap type TR tube by producing a relatively high value of electric field strength in the region of the truncated cones 16 and 18. Additionally disposed with the waveguide section are two auxiliary electron sources 26 and 28 which are of the radioactive ignitor type. For the purposes of this embodiment, the sources 26 and 28 are shown coupled to the iris plates 22 and 24, respectively, for support. It is understood by those skilled in the pertinent art that the sources 26 and 28 may be supported by other structures such as small rods or diaphragms extended from the waveguide walls or iris plates. More important is that the sources 26 and 28 be positioned such that electrons exiting therefrom are directed to the cone gap 20 and that such positioning does not disturb the resonance-filter circuit relationship between the capacitive cones and iris plates.

In operation, the receiver protector of FIG. 1 which may function similar to that of a TR tube serves to substantially attenuate the amplitude of a transmitted microwave signal above a predetermined threshold level before it reaches the radar receiver. It is understood that receiver protectors of the microwave cone gap type are not perfect attenuators and that some microwave power always leaks through to the receiver. The envelope of this R-F leakage pulse comprises at least a short-duration large-amplitude "spike" which normally results because of the finite time lag required for breakdown of the r.f. gap. If the energy within the leakage spike is too large, it may cause deleterious effects to certain elements of the radar receiver, for example. To reduce the amount of spike energy leakage to a safe amount, an auxiliary electron source, such as the radioactive ignitors 26 and 28 of FIG. 1, are supplied in the vicinity of the cone gap 20 to increase the electron concentration diffused into the gap 20, where this electron concentration acts to trigger the breakdown of the gap 20 once RF power is transmitted. The present embodiment employs a type of radioactive ignitors which increases the electron concentration to levels which ensure reliable and rapid low threshold breakdown of the discharge gap 20 to provide adequate receiver protection against the energy developed under the large-amplitude leakage "spikes" resulting from the breakdown time lag associated with the RF power transmission. A description of the radioactive ignitors and their function in relation to the performance of the breakdown of the receiver protector described in connection with FIG. 1 will follow hereinbelow.

Referring to FIG. 2, a cross-sectional view of the radioactive ignitor 26 (28) is shown in relation to the gap 20 and truncated cones 16 and 18. A plate of radioactive material 30 may be disposed on a substrate supporting structure 31 which may be comprised of the material titanium tritide. The radioactive plate 30 has at least one surface 32 which is operative to emit beta particles (electrons) hemispherically therefrom as a result of nuclear decay, the emitting surface 32 being opposite the surface of the plate 30 which interfaces the substrate 31. It is preferred that the radioactive material 30 be comprised of a metallic tritide similar to that having the formula $TiH^3$ which is considered an active electron source. The emitting surface 32 is preferably positioned in a plane which is substantially transverse to the plane 33 of an elevation cross-section of the microwave discharge gap 20. A tubular enclosure 34 has one end coupled substantially about the periphery of the emitting surface 32, having walls 38 longitudinally extended to the gap 20 with respect to the plane 33. Accordingly, the other end of the tubular enclosure 34 is directed to the gap 20, whereby the tubular enclosure 34 may restrict the hemispherical emission of beta particles 36 from the emitting surface 32 to the channel formed by its walls 38. Consequently, a portion of the emitted beta particles 36 are caused to strike the inner wall 40 of at least one of the walls 38 of the enclosure 34. While the tubular structure 34 is shown as a cylindrical enclosure in the preferred embodiment of FIGS. 1 and 2, an enclosure having a channel formed by three or more adjacently connected walls may also be suitable for use in the present embodiment. However, it is felt that the cylindrically shaped tubular enclosure 34 is optimally suited for the purpose of embodying the principles of the invention because of its inner wall surface and the relative ease by which it may be manufactured.

The inner walls 40 of the enclosure 34 may be comprised of a lossy material, similar to that of silver magnesium oxide, which is selected for its high secondary electron emission characteristics. This lossy material may also be selected to have a maximum secondary electron yield at the mean range of tritium beta energy. The inner diameter of the preferred cylindrical enclosure 34 may be made small enough such that the beta particles 36 which are directed toward the inner walls 40 do not incur excessive gas molecule collisions in their flight. For this reason, the emitted beta particles 36 will almost always have sufficient energy to release secondary electrons 37 upon impact with the inner walls 40. In the case where the waveguide section 10 is gas filled such as that described hereinabove, these beta particles which follow axial paths in exiting the enclosure 34 (i.e. not striking the inner walls 40) may dissipate most of their energy in gas particle collisions releasing secondary electrons by what is generally referred to as primary Townsend ionization. Since the exit end of the enclosure 34 is in close proximity to the gap 20, generally on the order of 0.09 to 0.140 inches (nominally 0.125 inches), it is evident that the total electron concentration will be greater at the gap 20 than at the radioactive plate source 32 due primarily to the mechanical constraint of the enclosure 34 and the secondary emission from the collision of the beta particles 36 with the inner walls material 40 and forced gas particle collisions.

In a typical TR tube embodiment such as that described in connection with FIGS. 1 and 2, the microwave gap 20 may be adjusted typically within a range of 0.003 to 0.01 inches in length. A suitable diameter of radioactive plate 30 in relation to the size of the gap length is on the order of 0.125 to 0.25 inches. With respect to these figures, it has been theoretically determined that approximately a 3:1 ratio between the diameter of the plate 30 and the length of the enhancement enclosure 34 may provide an optimum number of bounces of the emitted beta particles 36 from the inner walls 40 without slowing down the energy of the particles 36 which would render them ineffective to cause more secondary emissions 37 upon striking the inner wall material 40. In addition, the outer portion 42 of the walls 38 may be comprised of an insulating material, similar to that of aluminum oxide having the formula $Al_2O_3$, which permits positioning the enhancement cylinder 34 closer to the gap 20 without interfering with the electric field generated by the discharge of the gap 20. The insulator 42 may be made transparent to microwave energy so as not to significantly increase stage insertion loss.

The advantages of a radioactive ignitor using an enhancement enclosure such as the one described in connection with the preferred embodiments of FIGS. 1 and 2 over that of a basic radioactive button are considered in the following discussion. Basic radioactive foils containing generally 45 millicuries of tritium in the absence of an enhancement enclosure and a gas (no collisions) may yield currents on the order of 75 picoamperes. Assuming a gas is present at a pressure of approximately 8 torrs, the yielded current may be increased by 8. It is estimated that the increase in electron concentration due to secondary yield at the surface of a cylindrically shaped enclosure is roughly doubled or tripled. Another multiplication of the electron concentration, and probably the most significant, is the focusing effect of the enhancement enclosure. Assuming a cylindrically shaped enclosure, this focusing effect may be roughly equal to the ratio of solid angles which the microwave discharge gap 20 subtends (see FIG. 2) or $(1\text{-}\cos\theta)^{-1}$. The ratio of solid angle without enhancement cylinder to solid angle with enhancement cylinder may be represented mathematically by the following equation:

$$\frac{\psi w}{\psi_{wo}} = \frac{2\pi}{2\pi\,(1 - \cos\theta)} = (1 - \cos\theta)^{-1} \qquad (2)$$

From equation (1) above and for an example where $\theta \cong 15°$, the focusing effect of the enhancement cylinder 34 yields a multiplication of electron concentration of approximately $(1\text{-}\cos 15°)^{-1}$ or 30. Considering all three enhancement factors: gas pressure; secondary yield; and focusing effect, for the example described above, the total expected multiplication of electron concentration may be approximately $8 \times 2 \times 30 = 480$. Consequently, the basic radioactive foil current of 75 picoamperes (in vacuum) may be significantly increased to about 36 nanoamperes utilizing an enhancement enclosure cylindrically shaped similar to that described in connection with FIGS. 1 and 2.

in an alternative embodiment as shown in FIG. 3, a radioactive ignitor 26 (28) employing an enhancement tubular enclosure 34 additionally has a distributed accelerating electrical potential $V_A$ applied across the longitudinal extension of its walls 38 for the purpose of enhancing slow secondary electrons 37 which are emitted at the priming electron exit port 50 in the vicinity of the microwave cone gap 20 (see FIGS. 1 and 2). A battery 51, similar to the type manufactured by Catalyst Research Corporation denoted as a 10-year plug-in lithium-iodine battery, may be used with an insulating type enclosure surface material 42, such as aluminum oxide ($Al_2O_3$), which may serve as both the wall 38 and the secondary emitting surface 40 (see FIG. 2). The released secondary electrons 37 from both the beta particles 36 impacting with the wall material 42 and the beta particles 36 impacting with the gas-atoms 39 may have energies in the range of 25 to 35 electron-volts (ev). These secondary electrons 37 and the beta particles 36 may be accelerated toward the opening 50 of the enclosure 34 by the applied battery voltage, $V_A$, which is distributed along the walls 38 of the tubular enclosure 34 in relation to the resistivity of the material 42 comprising the walls 38. The number of electrons/unit time (current) exiting the open end 50 of the enclosure 34 is a function of the enclosure length and the value of the potential, $V_A$. Given a proper length of tubular enclosure 34 and associated value of potential $V_A$, it is anticipated that currents in excess of the 100 $\mu$A, typical of conventional d-c ignitors, may be generated.

While the embodiment depicted in FIG. 1 shows two auxiliary electron sources (radioactive ignitors), it is understood that one or more than two may also be used to suit design considerations without deviating from the principles of the present invention. Likewise, while only one pair of truncated cones and formed cone gap is shown in the same embodiment (FIG. 1), it is further understood that a receiver protector having more than one pair of cones forming more than one cone gap may also be used to embody the principles of the present invention. Still further, while the embodiment has been described in connection with a TR tube receiver protector, additional radar applications, such as a vacuum-type multipactor power limiters, may also provide similar embodiment environments.

It is desired, then, that the principles of the present invention be not limited to any one embodiment, but be construed on the scope and breadth set forth in the claims to follow.

I claim:

1. A radar receiver protector comprised of a waveguide section having disposed therein in a low pressure gaseous environment at least one pair of truncated cone electrodes forming at least one microwave discharge gap; at least two iris plates positioned in said waveguide section in relation to each pair of truncated cones to form a tuned resonant-filter to aid in the breakdown process of said receiver protector; and a radio-active ignitor for providing an auxiliary source of electrons for said microwave discharge gap to yield reliable and rapid low threshold cone gap breakdown protection against large-amplitude spike leakage to a receiver, said radioactive ignitor comprising:

at least one plate of radioactive metallic tritide material having at least one surface operative to emit beta particles as a result of nuclear decay of the metallic tritide, said each emitting surface being positioned substantially transverse to the elevation plane of said microwave spark gap for emitting beta particles hemispherically toward said microwave discharge gap;

a cylindrical enclosure of a circular cross-section for each radioactive plate, one end of each of said cylindrical enclosures being used to substantially enclose the emitting surface of a corresponding radioactive plate to restrict the hemispherical flow of beta particles from said plate to the channel of said cylindrical enclosure, the other end of said cylindrical enclosure, which is open, being directed towards said microwave discharge gap which is located a predetermined distance therefrom, said interior surface of said cylindrical enclosure being comprised of a material having the characteristics of high secondary emission of electrons, the length of said cylindrical enclosure being substantially greater than the diameter thereof to cause optimally a first portion of the emitted beta particles to strike the interior surface of said cylindrical enclosure rendering a first amount of additional electrons from the interior surface as a result of secondary emission, and to force a second portion of emitted beta particles to collide with the gas particles of said gaseous environment within the cylindrical enclosure releasing a second amount of additional electrons as a result of said gas particle collisions, said emitted beta particles and first and second amounts of additional electrons effecting a multiplication of the emitted beta particles which are guided by said cylindrical enclosure to said microwave discharge gap.

2. The radar receiver protector in accordance with claim 1 wherein cylindrical structure has a length which is approximately three times the size of its diameter.

3. The radar receiver protector in accordance with claim 1 wherein the interior surface material of the enclosure is silver magnesium oxide.

4. The radar receiver protector in accordance with claim 1 wherein the cylindrical enclosure comprises a resistive material for supporting a voltage potential distributedly applied longitudinally thereacross; and including a voltage source coupled to the cylindrical enclosure for applying a voltage potential longitudinally thereacross to accelerate the multiplication of electron particles to the open end of the cylindrical enclosure.

5. The radar receiver protector in accordance with claim 1 wherein the tubular enclosure is comprised of aluminum oxide.

* * * * *